United States Patent [19]

Bolis

[11] 4,108,523

[45] Aug. 22, 1978

[54] ELECTRIFIED CHANNEL, EQUIPPED WITH A SNAP-ACTING CONNECTOR

[75] Inventor: Edoardo Bolis, Milan, Italy

[73] Assignee: ITT Industries, Incorporated, New York, N.Y.

[21] Appl. No.: 800,506

[22] Filed: May 25, 1977

[51] Int. Cl.[2] ..... H01R 13/54

[52] U.S. Cl. ..... 339/22 B; 339/75 M

[58] Field of Search ..... 339/22 R, 22 B, 75 R, 339/75 N, 91 R

[56] References Cited

U.S. PATENT DOCUMENTS

| | | | |
|---|---|---|---|
| 3,015,795 | 1/1962 | Meacham | 339/22 B X |
| 3,273,103 | 9/1966 | Ericson | 339/22 B |

FOREIGN PATENT DOCUMENTS

| | | | |
|---|---|---|---|
| 1,220,077 | 5/1960 | France | 339/22 B |

*Primary Examiner*—Roy Lake
*Assistant Examiner*—E. F. Desmond
*Attorney, Agent, or Firm*—John T. O'Halloran; Alfred C. Hill

[57] ABSTRACT

An improved electrified channel where the channel has four leads, one of which acts as a middle or neutral wire, while the remaining three leads act as phases of three distinct electric circuits. Two contactors are associated with the related connector, such as a stationery contactor acting as neutral, and a movable contactor for the selection of the three phases.

2 Claims, 5 Drawing Figures

1
2
3
4
5
6

FIG. 2.
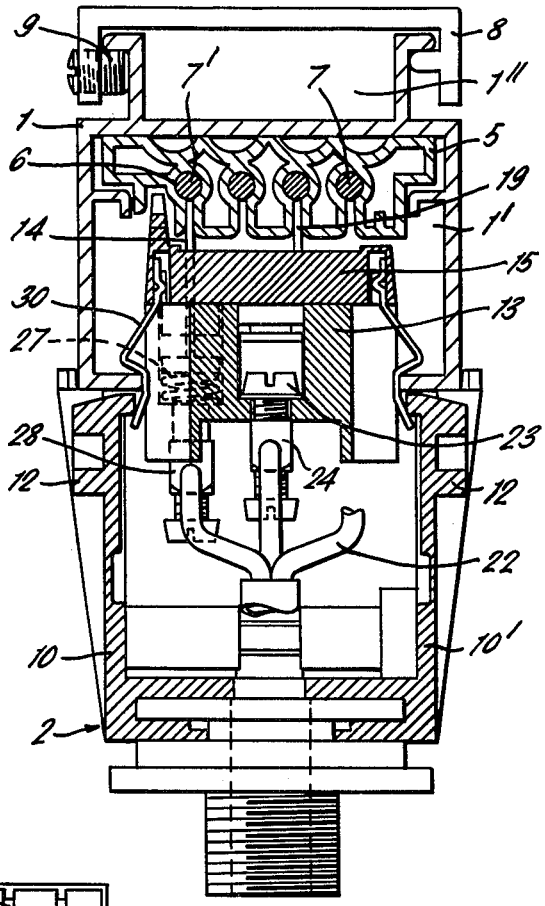
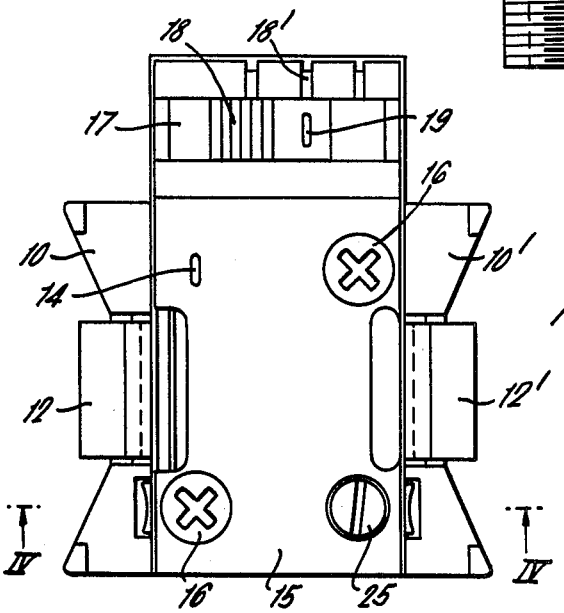
FIG. 3.

ELECTRIFIED CHANNEL, EQUIPPED WITH A SNAP-ACTING CONNECTOR

BACKGROUND OF THE INVENTION

This invention relates to improvements made in, and to electrified channel equipped with a snap-acting connector, as disclosed and claimed in my U.S. Pat. No. 4,029,378.

As seen in the above-cited U.S. patent there is an electrified channel and a related snap-acting connector, designed in such a manner as to offer the possibility of utilizing two different and independent circuits on the same electric line, provision being made for three leads located side by side, of which the central one is designed to act as a phase, while the sidewise located leads are designed to act as neutrals for the two circuits.

The particular arrangement of contactors on the snap-acting connector, allows for a twofold possibility of connection of the connector in the channel, thereby ensuring the utilization of the two independent electric circuits.

SUMMARY OF THE INVENTION

The main improvement made in, and to the object of my above-cited U.S. patent, consists in having four leads fitted side by side within the channel, one of such leads being designed to act as a neutral wire, while the remaining three leads are designed to act as phases of three distinct electric circuits.

Fitted on the related snap-acting connector are two contactors, the first of which is in a fixed position with respect to a conductor to establish contact with the neutral wire, when the connector is inserted into the channel, while the second contactor is connected with a movable pawl, for the selection of phase, according to a particular circuit, which is to be utilized.

Be suitably U-linking the phases, different solutions can be realized, e.g. a threefold lightning of an illumination plant, whereby to adjust the distribution of light according to requirements, or a twofold lightning, leaving the third conductor available as an emergency circuit, for the night lightning, line radio or even further solution as function of the most different applications.

BRIEF DESCRIPTION OF THE DRAWING

The further features and advantages of electrified channel with snap-acting connector will be better appreciated from a consideration of a preferred embodiment thereof, as shown in the accompanying drawings, both description and drawings being given as a non restrictive example only. In the drawings:

FIG. 2 is a cross-section of the channel with the switched-in connector;

FIG. 3 is a plan view of the switched-out connector;

DESCRIPTION OF THE PREFERRED EMBODIMENT

Figure 1:
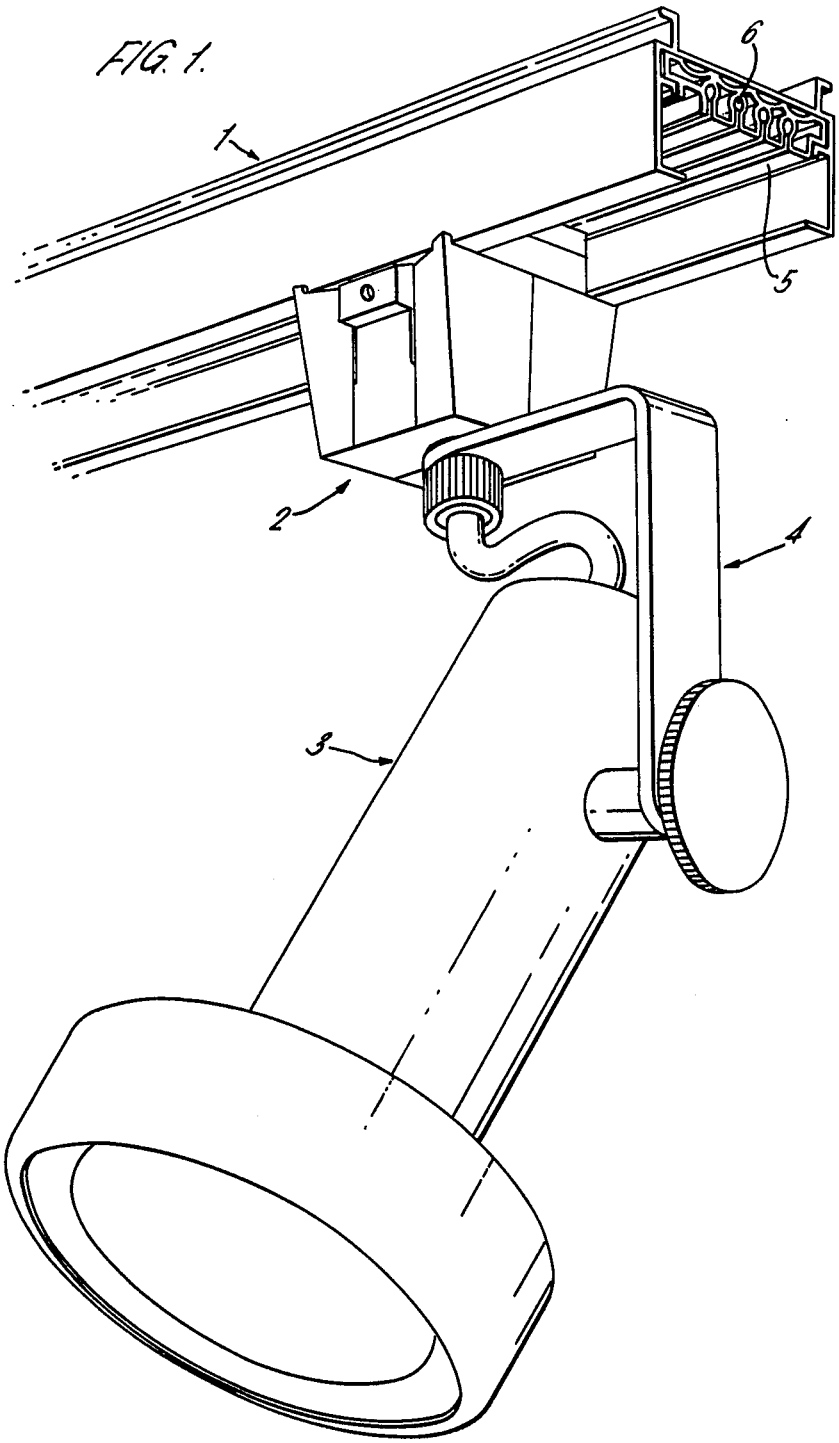
FIG. 1 is a perspective view, showing the electric canalization system in its whole.

Referring now to the Figures, fitted on the electrified channel, indicated in its entirety by the numeral 1, is a connector, small in size, also indicated in its entirety by the numeral 2, for feeding electric current to any lighting plant, as e.g. the variable slope lamp 3, as shown in FIG. 1, which is linked to connector 2 by the supporting bracket 4. The channel 1, made of an aluminium section, is shaped in such a manner as to define two bays 1' and 1'', respectively (see FIG. 2). Slidingly fitted in the bay 1' is a PVC-extruded insulating body 5, having seats 6, wherein the four leads 7, made of copper wires, are secured, while in the bay 1'' cables for different purposes, and in particular cables for feeding the channel 1 may be laid.

The channel 1 may be hung by the drop hanger 8, or at any rate ceiling fitted or embedded. The provision of a single setscrew 9 allows to bring the channel 1 from below in position into the drop hanger 8, without need of having the channel axially slid into said hanger, whereupon the channel can be firmly fastened by tightening the setscrew 9.

The channel 1 may have any length, since it is formed by cut-down sizes connected by abutting joints, while the leads 7 may be either continuous, or connected by intermediate terminals. Such terminals (not shown in the drawings) may be differently shaped, e.g. angle-, cross- or Tee-shaped, to allow for the laying of electrified channel in any geometric layout.

The four leads 7 are located side by side, the first lead 7' (see FIG. 2) being designed to act as a neutral wire, while the remaining three leads are designed to act as phases of three distinct electric circuits.

Figure 4:
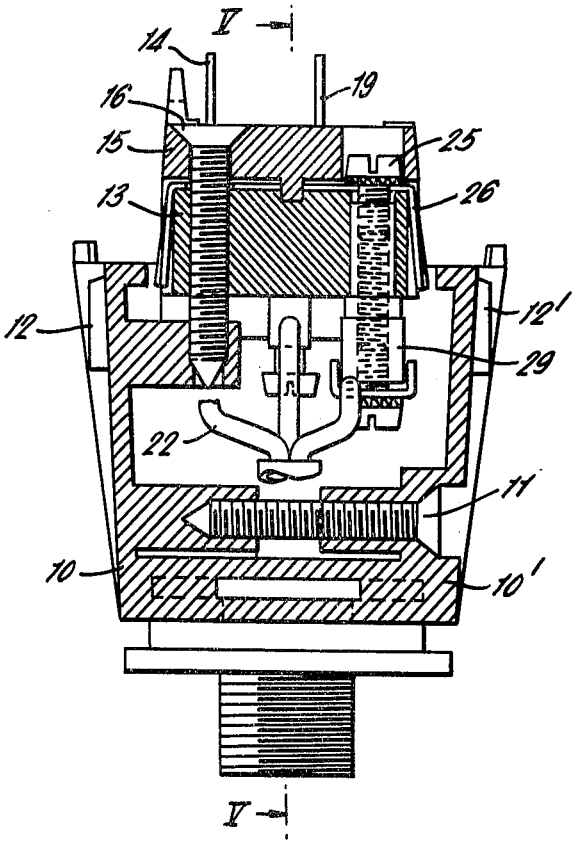
FIG. 4 is a section taken along line IV—IV of FIG. 3.
Figure 5:
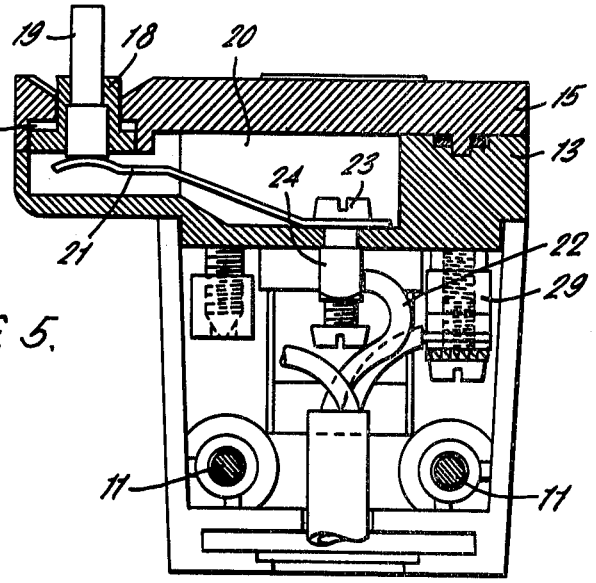
FIG. 5 is a section taken along line V—V of FIG. 4.

The connector 2 consists of two enclosing semi-caps 10 and 10', secured with one another by self tapping sctews 11 (see FIGS. 4 and 5), and which side walls are formed with notches, to define two elastically resilient portions, by which the pawls 12 and 12' are carried.

Abuttingly fitted above semicaps 10 and 10' is the body 13, acting as a guide for the contactor 14, by which the contact with the neutral wire is established, the related cover 15 being secured to said semi-caps by self-tapping screws.16.

Formed in the cover 15 is a seat 17 wherein the pawl 18 is fitted, said pawl carrying the movable contactor 19, by which the connection with one of the three phases is established, and said seat being formed with suitable notches (18') for retaining said pawl 18 on the selected phase.

Fitted in the space 20 (see FIG. 5) as defined between the body 13 and the cover 15, is a leaf spring 21, for the connection between the contactor 19 and the electric cables 22, by means of the screw 23 and the terminal 24.

Moreover, fitted in the body 13 are the earthing screw 25, connected with the grounding leaf spring 26, as well as the biasing spring 27, by which the neutral connecting contactor 14 is acted upon. Both the contactor 14 and the earthing screw 25 are connected with the cables 22 by the connecting terminals 28 and 29, respectively.

30 is the supporting spring, that allows for the snap-insertion of connector 2 into the channel 1, with the electrical connection for the engagement of the two contactors 14 and 19 with the leads 7, under the action of pressure spring 27 and of leaf spring 21, respectively, while the grounding spring 26 is connected with the channel 1.

By suitably selecting the position of contactor 19 by means of pawl 18, before the connector 2 is inserted into the channel 1, the possibility is given to utilize one, or two, or three electric circuits independent from each other, for interesting applications, e.g. differentiated lightings, emergency circuits, night lighting, line radio etc.

What we claim is:

1. An electrified channel equipped with a snap-acting connector comprising:

four wire rods located side by side in said channel, one of said rods acting as a neutral wire and the remaining of said rods acting as phases of three distinct electric circuits;

contactors of said connector being elastically engaged with two of said rods when said connector is inserted into said channel;

one of said contactors being disposed in a fixed position to establish contact with said neutral wire when said connector is inserted into said channel;

a movable contactor to establish contact with one of said remaining of said rods according to a selected one of said three circuits;

a body having a cover to provide a guide for said one of said contactors by which a connection is established with said neutral wire;

two semi-caps encircling a portion of said body remote from said cover, said caps being secured to one another by self-tapping screws; and a seat in which said movable contactor is slidingly fitted to establish a contact with one of said remaining of said rods;

said movable contactor being supported by a pawl which is slidingly fitted in a seat formed in said cover; said seat being formed with suitable notches for retaining said pawl on a selected one of said remaining of said rods.

2. A snap-acting connector according to claim 1, wherein a space is disposed within said connector cover, a leaf spring is disposed in said space to provide a connection between said movable contactor and electric cables by means of a screw and a terminal.

* * * * *